United States Patent [19]

Yoshida et al.

[11] Patent Number: 4,542,060

[45] Date of Patent: Sep. 17, 1985

[54] NONWOVEN FABRIC AND PROCESS FOR PRODUCING THEREOF

[75] Inventors: Seiichi Yoshida; Shigekazu Takeuchi, both of Okayama, Japan

[73] Assignee: Kuraflex Co., Ltd., Japan

[21] Appl. No.: 611,781

[22] Filed: May 18, 1984

[30] Foreign Application Priority Data

May 26, 1983 [JP] Japan ..... 58-93476

[51] Int. Cl.[4] ..... B32B 27/34

[52] U.S. Cl. ..... 428/287; 28/103; 28/104; 28/112; 428/219; 428/284; 428/296; 428/298; 428/299

[58] Field of Search ..... 428/219, 224, 225, 227, 428/288, 284, 287, 299, 296, 373, 298; 28/103, 104, 112

[56] References Cited

U.S. PATENT DOCUMENTS

| | | | |
|---|---|---|---|
| 3,272,898 | 9/1966 | Knee | 28/103 |
| 3,917,448 | 11/1975 | Wood | 28/103 |
| 4,190,695 | 2/1980 | Niederhauser | 428/300 |
| 4,258,093 | 3/1981 | Benedyk | 428/300 |
| 4,258,094 | 3/1981 | Benedyk | 428/296 |
| 4,296,168 | 10/1981 | Ambrose | 428/296 |
| 4,373,000 | 2/1983 | Knobe et al. | 428/284 |
| 4,426,420 | 1/1984 | Likhyoni | 428/299 |
| 4,500,384 | 2/1985 | Tomeoka et al. | 428/373 |
| 4,511,615 | 4/1985 | Ohta | 428/373 |
| 4,515,854 | 5/1985 | Hogame et al. | 428/299 |

*Primary Examiner*—James J. Bell

*Attorney, Agent, or Firm*—Jones, Tullar & Cooper

[57] ABSTRACT

A laminated nonwoven fabric having excellent bulkiness, softness and strength without cleavage of plys and fluff of fibers on the surface thereof which comprises a web mainly composed of a fiber having a high melting point or being hardly softened or molten (laminate ply A), and one or more webs mainly composed of a thermoplastic fiber which soften or melt more easily than the fiber of the laminate ply A (laminate ply B), said ply B being integrally bound to said ply A by steric entanglement of both fibers composing the plys A and B as well as partial softening or melting of the fibers composing the ply B. The laminated nonwoven fabric is produced by subjecting a laminated web made of different kinds of fibers to a fluid injection entangling treatment and then a dry heat treatment.

11 Claims, No Drawings

NONWOVEN FABRIC AND PROCESS FOR PRODUCING THEREOF

FIELD OF THE INVENTION

The present invention relates to a laminated nonwoven fabric which comprises laminate plys of web made of different kinds of fibers having different softening and melting points and a process for producing thereof. More particularly, the laminated nonwoven fabric of the present invention has such a structure that the laminate plys thereof are bound to each other by steric entanglement of fibers forming adjacent two laminate plys as well as partial softening or melting of the fiber having a lower softening and melting points without softening or melting of the other fiber having a higher softening and melting points, whereby cleavage between the laminate plys is prevented and the laminated nonwoven fabric of the present invention shows excellent bulkiness, softness and strength in the entire fabric as well as less fluff of fibers on the surface thereof.

PRIOR ART AND BACKGROUND OF THE INVENTION

Japanese Patent Publication No. 18069/1972 and Japanese Patent Laid Open Publication No. 82077/1976 disclose techniques very pertinent to the present invention. However, they do not teach the laminated nonwoven fabric of the present invention, particularly, the mode of bond of the laminate plys.

That is, Japanese Patent Publication No. 18069/1972 discloses the production of a nonwoven fabric of entangled fibers obtained by injecting an incompressible fluid in the form of a columnar flow having a momentum flux of not less than 6 kg m/sec$^2$ cm$^2$. This publication also discloses that, after the treatment of the columnar flow, the resulting nonwoven fabric is subjected to a dry or wet heat treatment to develop crimp and self-extensibility of web-forming fibers and to make the entire web more bulky. Further, Examples of this publication disclose not only a single-ply web having a fabric weight of about 10 to 400 g/m$^2$ but also a two- or three-ply web. Particularly, Example 30 thereof discloses a laminated nonwoven fabric having a sandwich structure of three-ply web having the middle ply of which is made of a fiber having a lower softening and melting points (nylon) and each of the outer two plys of which is made of a fiber having a higher softening and melting points (polyester). However, this publication does not teach the heat treatment of the present invention wherein only a web-forming fiber composing one laminate ply is softened or molten and laminate plys are bound to each other by partial softening or melting of a fiber having a lower softening and melting points without softening or melting of a fiber having a higher softening and melting points as in the present invention. In fact, in practice, there is a possibility of cleavage of plys of the nonwoven fabric of this publication and fluff of fibers on the surface thereof is insufficiently improved.

Japanese Patent Laid Open Publication No. 82077/1976 discloses to subject a laminated web to a fluid entangling treatment and partial softening or melting of web-forming fibers. However, this publication discloses only a laminated web made of the same kinds of fibers. That is, this publication merely discloses the treatment of a laminated web made of the same kinds of fibers by an entangling treatment with fluid and then heating. Accordingly, fibers which forms adjacent both plys of web are uniformly softened or melted, and hence, the resulting nonwoven fabric is liable to become flattened and hard.

In order to obtain a laminated nonwoven fabric having improved characteristics which hardly shows cleavage of laminate plys and hardness of tissue, the present inventors have intensively studied. As the result, it has been found that a desired laminated nonwoven fabric having excellent characteristics is obtained by employing different kinds of fibers having different softening and melting points of which hardly undergoes the effect of heat during a heat treatment of laminate plys of web.

SUMMARY OF THE INVENTION

The main object of the present invention is to provide a laminated nonwoven fabric having improved characteristics which hardly shows cleavage of laminate plys and does not have a hard tissue. Another object of the present invention is to provide a process for producing such a laminated nonwoven fabric having improved characteristics.

These objects as well as other objects and advantages of the present invention will become apparent to those skilled in the art from the following description.

According to the present invention, there is provided a laminated nonwoven fabric which comprises a web mainly composed of a fiber having a high melting point or being hardly softened or molten (hereinafter referred to as laminate ply A), and at least one web mainly composed of a thermoplastic fiber being soften or molten more easily than the fiber of the laminate ply A (hereinafter referred to as laminate ply B) and provided on the surface of the laminate ply A, said ply B being integrally bound to said ply A by steric entanglement of both fibers composing the plys A and B as well as partial softening or melting of the fibers composing the ply B. The nonwoven fabric of the present invention is produced by disposing the laminate ply B on at least one surface of the laminate ply A to obtain a laminated web, injecting an incompressible fluid to the resulting laminated web to entangle the fibers composing both plys A and B, and then subjecting the resultant to a dry heat treatment under such a temperature that is over the softening and melting points of the fiber of the ply B and is below the softening and melting points of the fiber of the ply A to soften or melt at least a part of the fiber of the ply B.

DETAILED EXPLANATION OF THE INVENTION

The laminated nonwoven fabric of the present invention has two or more laminate plys of web made of different kinds of fibers, i.e., the laminate plys A and B, and it is subjected to the fluid entangling treatment and then the heat treatment for partial softening or melting of the fiber of only the laminate ply B.

(A) Preparation of Web

In the laminated nonwoven fabric of the present invention, the fiber of the laminate ply A hardly undergoes the effect of heat. That is, the fiber is not softened or molten during the heat treatment. Preferred examples of the fiber are a rayon fiber having no softening and melting points, a polyester or polypropylene fiber having a relative high melting point and the like. Particularly, when the nonwoven fabric for facing sheet which has susceptibility to fluid is desired, it is preferable to use mainly a rayon, polyester or polypropylene fiber such as above. When the nonwoven fabric used as a wiper for sweeping oil is desired, it is preferable to use the above polyester or polypropylene fiber rather than a rayon fiber. Since the laminate ply A mainly contributes to bulkiness and flexibility of the nonwoven fabric in the present invention, preferably, the ply A has a function of the principal fabric layer, and has a fabric weight of 8 to 85 g/m$^2$.

On the other hand, the laminate ply B is mainly composed of a thermoplastic fiber having a low softening and melting points and being softened or molten more easily than the fiber of the laminate ply A. Examples of the fiber are a nylon 6 fiber, a polyethylene fiber, a core-sheath conjugated fiber consisting of a polypropylene core and a polyethylene sheath, a copolyester fiber, an undrawn polypropylene fiber and the like. These fibers can be used alone or in the combination thereof. The laminate ply B may contain the fiber composing the ply A in an amount not more than 10% by weight based on the total weight of the fibers composing the ply B. Since, usually, the plys B is the secondary layer for supporting the function of the ply A, the fabric weight thereof may be 4 to 15 g/m$^2$.

The nonwoven fabric of the present invention is a multi-ply laminated nonwoven fabric having two or more laminate plys and the laminate ply B can be provided on either or both surfaces of the laminate ply A. Preferably the laminate plys B are provided on both surfaces of the laminate ply A because fluff on both surfaces of the nonwoven fabric can be prevented with maintaining more bulkiness and providing improved strength such as less cleavage of plys. Thus, the combination of the laminate plys in the present invention can be suitably selected based on the following thermal properties of the fibers, characteristics of fibers and characteristics of desired nonwoven fabric.

| Fiber | Rayon | Polyethylene | Polypropylene | Polyester | Nylon 6 | Nylon 6,6 |
|---|---|---|---|---|---|---|
| Softening point (°C.) | No softening or melting | 100–115 | 140–160 | 238–240 | 180 | 230–235 |
| Melting point (°C.) | Decomposition at 260–300° C. | 125–135 | 165–173 | 255–265 | 215–220 | 250–260 |

As mentioned above, the fibers which compose the webs in the present invention can be suitably selected and combined according to the uses of the desired nonwoven fabric and any conventional fiber can be employed regardless of whether a staple fiber or a filament, whether a fiber having a circular cross section or a fiber having a non-circular cross section, or whether a nonporous fiber or a hollow fiber, and further regardless of degree of fineness, use of an oiling agent and the presence of crimp.

(B) Entangling Treatment for Fibers of Web

An incompressible fluid, typically, water is injected to the above laminated web having two or more laminate plys to occur entanglement of fibers which compose the plys in respect of the cross sectional direction of the nonwoven fabric. Although the resulting nonwoven fabric may have holes regularly or irregularly arranged at the parts where the fibers are substantially absent, when the nonwoven fabrics is to be used for facing sheet, it is preferable that it does not contain any holes having a size of about 1 mm$^2$ or more because the fabric shows an excellent susceptibility to fluid and prevents returning back of fluid to the surface thereof after once it has been absorbed. On the other hand, the nonwoven fabric used for a wiper may have such holes.

In the present invention, the entangling treatment for fibers can be carried out under conventional conditions as described in the above prior art and the angle of the injection of the fluid can be varied according to the desired use of the nonwoven fabric. For example, where formation of holes is desired, a spraying flow of the fluid at an angle of not less than about 15° is effective and, when there is no need to form holes on the nonwoven fabric, a columnar flow at an angle of not more than 5° can be employed. In general, the injection pressure and the feed rate of the injection fluid are selected from the ranges of 10 to 50 kg/cm$^2$ and 1 to 3 cc/cm$^2$, respectively, by taking into consideration of the size of an injection aperture and the distance between the aperture and the web. Usually, the preferred size of the injection aperture is 1 to 3 mm in diameter, and the preferred injection distance is 1 to 10 cm. In the present invention, two or more times of the injection treatment may be effected on the same laminated web. Such treatment of the present invention can occur steric entanglement of fibers between the adjacent two laminate plys as well as steric entanglement of fibers in laminate ply A to prevent cleavage of laminate plys. As mentioned above, optionally, the nonwoven fabric may have holes according to the uses of the desired nonwoven fabric. For example, it is rather preferable that the nonwoven fabric having a low fabric weight of about 15 to 35 g/m$^2$ used for facing sheet of a sanitary material has no hole on the surface. On the other hand, the nonwoven fabric having a fabric weight of not less than about 50 g/m$^2$ used for various wipers may have holes.

It should be noted that the desired effect of the present invention can not be obtained only by the above entanglement of fibers with fluid because, although cleavage of the plys can be considerably prevented by the entanglement, strength of the resulting nonwoven fabric and the prevention of fluff of fibers on the surface thereof are not yet sufficiently improved. Therefore, in the present invention, the following partial softening or melting treatment of the fiber composing the laminate ply B should be carried out.

(C) Softening or Melting Treatment of the Laminate Ply B

The nonwoven fabric resulting from the above entangling treatment is then subjected to a softening or melting treatment of the fiber composing the laminate ply B. The purpose of this treatment is to soften or melt only the fiber mainly composing the laminate ply B. Softening or melting of the fiber mainly composing the ply A should be avoided because the laminate ply A must maintain an original shape to provide bulkiness and flexibility. As the result of this treatment, most of the fibers composing the ply B are softened or molten to occur adhesion of the fiber of the ply B to the fiber of the ply A and also to occur adhesion to the fibers in the ply B. Thus, fluff of the fibers on the surface (the ply B side) of the nonwoven fabric can be fully prevented and strength of the entire nonwoven fabric can be improved. Particularly, in case of the laminated nonwoven fabric or the present invention which does not contain any holes having the area of about 1 $mm^2$ or more, this softening or melting treatment is very efficient since the strength of the nonwoven fabric is inferior to that of the nonwoven fabric having holes. This treatment of the present invention can be effected by a conventional heat treatment such as that using a hot-air dryer, a tenter, a hot calender and the like. By the way, the nonwoven fabric resulting from the above injection treatment with water should be dried prior to or during the softening or melting treatment.

In the heat treatment for softening or melting the fiber composing the ply B, deformation of all the fibers should be avoided so that a part of the fiber composing the ply B maintains entanglement with the fiber composing the ply A. Those skilled in the art will readily select the conditions of the heat treatment based on a particular fabric weight of web, running speed of web, heat treatment system and the like as shown in Examples hereinafter.

Thus, according to the present invention, the desired nonwoven fabric having a fabric weight of 15 to 100 $g/m^2$ which shows high strength, bulkiness and flexibility without fluff of the fibers on the surface and cleavage of the laminate plys can be obtained by means of the entangling treatment of fibers in the adjacent laminate plys made of the different kinds of fibers and the softening or melting treatment of only the fiber composing the ply B.

There is no prior art disclosing the combination of these two treatments of the laminated web made of the different kinds of fibers as in the present invention to simultaneously provide the desired properties to the resulting nonwoven fabric.

The laminated nonwoven fabric of the present invention has various improved properties and can be used in various fields. For example, the laminated nonwoven fabric of the present invention having a fabric weight of about 20 to 30 $g/m^2$ can be used as a facing sheet for a sanitary material. The laminated nonwoven fabric having a fabric weight of not less than about 50 $g/m^2$ is most suitably used as a wiper in the process for producing a precision machine and the like.

The present invention is further illustrated by the following Examples and Reference Examples, but should not be construed to be limited thereto.

In Examples and Reference Examples, flexibility and an amount of fluff of the nonwoven fabric were measured as follows:

(1) Degree of Flexibility (G)

Four sample pieces (21.5 cm×21.3 cm) prepared from the nonwoven fabric were used. The sample piece was put on the specimen carrier of Handle O Meter (manufactured by Thwing Albert Instrument, Limited) so that the longitudinal axis of the sample piece met at right angle to the slot (distance: 8 mm). The blade of penetrater was lowered at the position of 10.7 cm (one half of the width of the sample) and the maximum value (g) of the microammeter was read when the sample piece was pressed. The degree of flexibility (g) was calculated by subtracting the maximum value from 100 and expressed as the average of the four sample pieces.

(2) Fluff of Fibers (Counts/10 cm)

In principle, this was carried out by measuring an amount of fibers which were removed from the surface of the nonwoven fabric by wearing. The nonwoven fabric to be measured was cut to obtain a sample piece (30 cm×14 cm), which was then put on the specimen carrier and fixed by clamps without a slack of the sample. On the other hand, a metal rod was surrounded with a felted fabric. Then, the metal rod surrounded with felted fabric was smoothly slided back and forth for 10 times on the surface of the sample. Thereafter, fluffs of the sample which were adhered onto the felted fabric on the metal rod were removed carefully by a pincette and the number of fluffs was counted. The result was expressed as the average of 5 measurements (n=5).

EXAMPLES 1 TO 7 AND REFERENCE EXAMPLES 1 TO 5

The laminated webs as shown in Table 1 were put on a perforated metal supporting plate which was moving at a rate of 5 m/minute and then were subjected to a water injection treatment at a pressure of 10 $kg/cm^2$ (nozzle aperture diameter: 0.15 mm, fluid feed: 1.1 $cc/cm^2$, distance between nozzle and web: 50 mm) to occur entanglement of the fibers composing the webs. In Table 1, NBF indicates a core-sheath conjugated fiber of polypropylene polyethylene, PNS indicates an undrawn polypropylene fiber, PET indicates a polyester fiber, R indicates a rayon and PP indicates a polypropylene fiber. After drying, each entangled nonwoven fabric was subjected to the dry heat treatment by using a hot smoothing roll (135° C.) or a hot embossing roll (140° C., 0.5 $kg/cm^2$). The properties of the nonwoven fabric thus obtained are shown in Table 1. As is clear from Table 1, the nonwoven fabric obtained through both the water injection treatment and the dry heat treatment according to the present invention shows excellent balance in strength, degree of flexibility and less number of fluff of fibers as compared with that obtained by subjecting only to the either treatment.

TABLE 1

| | | Web | | Treatment | | | Characteristics of nonwoven fabric | |
|---|---|---|---|---|---|---|---|---|
| Test No. | Ply | Fiber | Fabric weight ($g/m^2$) | Water flow | Smoothing roll | Embossing roll | Fabric weight ($g/m^2$) | Thickness (mm of 4 sheets) |
| Ex. 1 | A | R70% + NBF30% | 20 | Yes | Yes | Non | 34.5 | 1.6 |
| | B | NBF100% | 10 | | | | | |
| Ex. 2 | A | PET70% + NBF30% | 20 | " | " | " | 29.6 | 1.8 |
| | B | NBF 100% | 10 | | | | | |

TABLE 1-continued

| | | | | | | | | |
|---|---|---|---|---|---|---|---|---|
| Ex. 3 | A | PP70% + NBF30% | 20 | " | " | " | 30.7 | 2.1 |
| | B | NBF100% | 10 | | | | | |
| Ex. 4 | B | NBF100% | 6 | " | " | " | 41.5 | 1.9 |
| | A | R90% + NBF10% | 28 | | | | | |
| | B | NBF100% | 6 | | | | | |
| Ex. 5 | A | PET70% + PNS30% | 20 | " | Non | Yes | 31.7 | 1.2 |
| | B | PNS100% | 10 | | | | | |
| Ex. 6 | A | PP70% + PNS30% | 20 | " | " | " | 29.5 | 1.0 |
| | B | PNS100% | 10 | | | | | |
| Ex. 7 | B | PNS100% | 6 | " | " | " | 35.9 | 1.3 |
| | A | R90% + PNS10% | 28 | | | | | |
| | B | PNS100% | 6 | | | | | |
| Ref. Ex. 1 | Single | R63% + NBF37% | 40 | " | Yes | Non | 40.9 | 1.8 |
| Ref. Ex. 2 | " | PET47% + PNS53% | 30 | " | Non | Yes | 31.4 | 1.3 |
| Ref. Ex. 3 | B | NBF100% | 6 | Non | Yes | Non | 41.0 | 2.0 |
| | A | R90% + NBF10% | 28 | | | | | |
| | B | NBF100% | 6 | | | | | |
| Ref. Ex. 4 | B | PNS100% | 6 | Yes | Non | " | 35.2 | 1.2 |
| | A | R90% + PNS10% | 28 | | | | | |
| | B | PNS100% | 6 | | | | | |
| Ref. Ex. 5 | B | NBF100% | 15 | " | Yes | " | 30.1 | 1.6 |
| | | NBF100% | 15 | | | | | |

| | Characteristics of nonwoven fabric | | | | | |
|---|---|---|---|---|---|---|
| Test No. | Length-wise strength (kg/30 cm) | Cross-wise strength (kg/30 cm) | Degree of flex-ibility (g) | Number of fluffs (count/10 cm) | Cleavage between Plys | Remark |
| Ex. 1 | 31.8 | 5.7 | 60 | 30–35 | Non | |
| Ex. 2 | 25.8 | 4.6 | 69 | 55–60 | " | |
| Ex. 3 | 30.0 | 4.4 | 48 | 10–15 | " | |
| Ex. 4 | 33.6 | 4.3 | 54 | 65–75 | " (Peel strength: 200–300 g/2.5 cm) | |
| Ex. 5 | 35.3 | 6.6 | 69 | 60–65 | Non | |
| Ex. 6 | 44.8 | 10.1 | 78 | 35–40 | " | |
| Ex. 7 | 15.6 | 3.9 | 81 | 70–75 | " | |
| Ref. Ex. 1 | 28.4 | 2.9 | 50 | 115–125 | " | *1 |
| Ref. Ex. 2 | 39.0 | 4.8 | 66 | 130–140 | " | *2 |
| Ref. Ex. 3 | 22.1 | 3.7 | 77 | 150–160 | Yes (Peel strength: 0 g/2.5 cm) | *3 |
| Ref. Ex. 4 | 2.5 | 0.2 | 82 | impossible (break at 20 times wearing) | Yes (better than that of Ref. Ex. 3 | *4 |
| Ref. Ex. 5 | 54.8 | 16.4 | 10 | 0–5 | Non | *5 |

*1 similar to Ex. 4
*2 similar to Ex. 5
*3 similar to Ex. 4 except no injection
*4 similar to Ex. 7 except no heat treatment
*5 similar to Japanese Patent Laid Open Publication 82077/1976

What is claimed is:

1. A laminated nonwoven fabric which comprises a web mainly composed of a fiber having a high melting point or being hardly softened or molten designated as laminate ply A, and at least one web mainly composed of a thermoplastic fiber being soften or molten more easily than the fiber of the laminate ply A and provided on at least one surface of the laminate ply A designated as laminate ply B, said ply B being integrally bound to said ply A by steric entanglement of both fibers composing the plys A and B as well as partial softening or melting of the fibers composing the ply B.

2. A laminated nonwoven fabric according to claim 1, wherein the fiber of the ply A is a rayon fiber, a polyester fiber or a polypropylene fiber.

3. A laminated nonwoven fabric according to claim 1, wherein the fabric has a fabric weight of 15 to 100 g/m$^2$.

4. A laminated nonwoven fabric according to claim 1, wherein the ply B is provided on one surface of the ply A.

5. A laminated nonwoven fabric according to claim 1, wherein the plys B are provided on both surfaces of the ply A.

6. A process for producing a laminated nonwoven fabric which comprises the steps of (a) disposing a web mainly composed of a thermoplastic fiber being easily softened or molten than the fiber of the laminate ply A designated as laminate ply B on at least one surface of a web mainly composed of a fiber having a high melting point or being hardly softened or molten designated as laminate ply A to obtain a laminated web;

(b) injecting an incompressible fluid to the resulting laminated web to entangle the fibers composing both plys A and B; and then (c) subjecting the resultant to a dry heat treatment under such temperature that is over the softening and melting points of the fiber of the ply B and is below the softening and melting points of the fiber of the ply A to soften or melt at least a part of the fibers of the ply B.

7. A process according to claim 6, wherein the fiber of the ply A is a rayon fiber, a polyester fiber or a polypropylene fiber.

8. A process according to claim 6, wherein the ply A has a fabric weight of 8 to 85 g/m$^2$, the ply B has a fabric weight of 4 to 15 g/m$^2$ and the entire laminated plys have a fabric weight of 15 to 100 g/m$^2$.

9. A process according to claim 8, wherein the ply A has a fabric weight of 8 to 25 g/m$^2$ and the entire laminated plys have a fabric weight of 15 to 35 g/m$^2$.

10. A process according to claim 6, wherein the ply B is provided on one surface of the ply A.

11. A process according to claim 6, wherein the plys B are provided on both surfaces of the ply A.

* * * * *